United States Patent [19]

Heitmann et al.

[11] Patent Number: 4,893,640

[45] Date of Patent: Jan. 16, 1990

[54] MULTIPLE-ROD CIGARETTE MAKING MACHINE

[75] Inventors: Uwe Heitmann; Manfred Goldbach, both of Hamburg, Fed. Rep. of Germany

[73] Assignee: Körber AG, Hamburg, Fed. Rep. of Germany

[21] Appl. No.: 275,078

[22] Filed: Nov. 22, 1988

[30] Foreign Application Priority Data

Dec. 12, 1987 [DE] Fed. Rep. of Germany ..... 3742251

[51] Int. Cl.[4] ..... A24C 5/18; A24C 5/31

[52] U.S. Cl. ..... 131/84.4; 131/84.1; 131/84.3

[58] Field of Search ..... 131/84.4, 84.3, 84.1

[56] References Cited

U.S. PATENT DOCUMENTS 4,336,812 6/1982 Sevagnoli ..... 131/84.4
4,418,705 12/1983 Seragnoli ..... 131/84.4
4,564,028 1/1986 Heitmann ..... 131/84.4
4,600,020 7/1986 Mattei et al. ..... 131/84.4
4,620,552 11/1986 Hinzmann ..... 131/84.3

*Primary Examiner*—V. Millin
*Assistant Examiner*—Jennifer L. Doyle
*Attorney, Agent, or Firm*—Peter K. Kontler

[57] ABSTRACT

A machine which simultaneously produces several rods of fibrous material has discrete conveyors which are closely adjacent each other and transport the streams from stream building stations to discrete surplus removing apparatus each of which employs a pair of coplanar trimming discs. The trimming discs of discrete surplus removing apparatus are disposed in different planes which are inclined relative to each other and can be inclined relative to or parallel with the planes of the respective conveyors. The orientation of the planes of the trimming discs ensures that the removal of surplus is not impeded by neighboring apparatus and/or by the channels for the streams of fibrous material.

13 Claims, 3 Drawing Sheets

Fig. 4
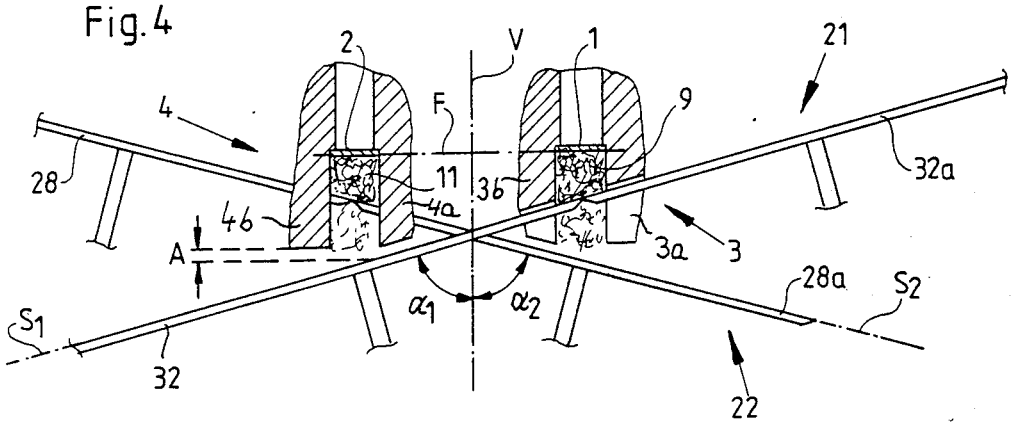
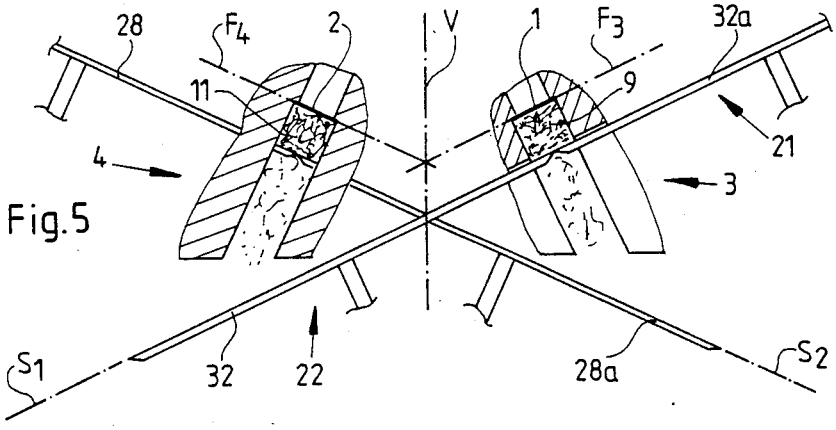
Fig. 5
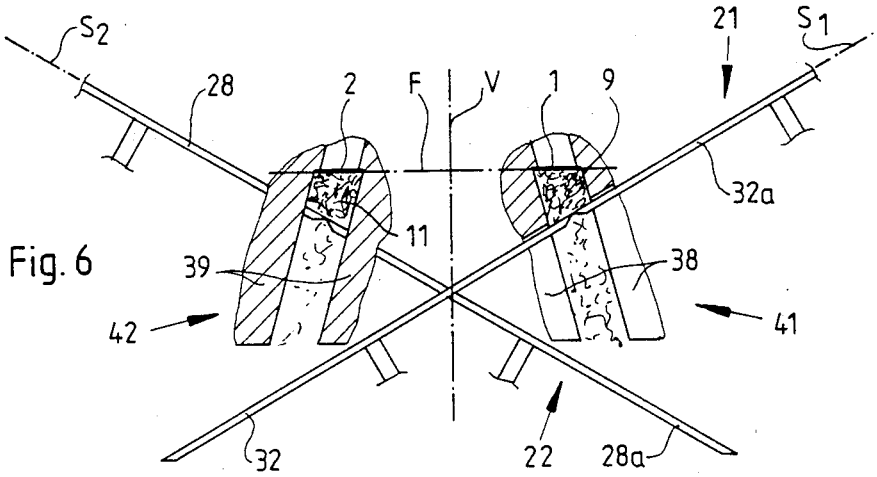
Fig. 6

MULTIPLE-ROD CIGARETTE MAKING MACHINE

CROSS-REFERENCE TO RELATED APPLICATION

The machine of the present invention constitutes an improvement over and a further development of the machine which is disclosed in commonly owned co-pending patent application Ser. No. 272,070 filed Nov. 16, 1988 by Uwe Heitmann et al. for "Method of and apparatus for building, guiding and trimming streams of fibrous material".

BACKGROUND OF THE INVENTION

The invention relates to improvements in machines for simultaneously making and trimming a plurality of streams of fibrous material, particularly for simultaneously producing at least two rod-like fillers of fibrous material of the tobacco processing industry.

It is already known to simultaneously build and process two or more streams of fibrous material, such a fragments of natural, reconstituted and/or artificial tobacco, which are formed with a surplus. The surplus must be removed prior to draping of the resulting rod-like fillers into webs of paper, imitation cork or other suitable wrapping material. As a rule, individual streams are caused to advance along closely adjacent discrete paths, and this creates problems during removal of the surplus by so-called trimming or equalizing apparatus.

U.S. Pat. No. 4,418,705 granted Dec. 6, 1983 to Seragnoli for "Method and relative manufacturing machine for simultaneously producing two continuous cigarette rods" discloses a twin rod making machine wherein the trimming apparatus comprise frustoconical surplus removing knives which operate in pairs and are disposed at opposite sides of the paths for the respective tobacco streams. The knives rotate about axes which are inclined with reference to the planes of the respective streams. The planes of the knives are inclined with reference to the planes of the tobacco streams in order to ensure that the channels wherein the streams advance cannot interfere with the surplus removing operations. A drawback of the patented machine is that the circulating cutting edges of the knives have components of movement in directions toward and away from the conveyors for the respective streams. This causes undesirable densification of the streams ahead of the surplus removing station. Such densification is unpredictable and can bring about pronounced changes in the characteristics of the streams.

A somewhat similar apparatus is disclosed in U.S. Pat. No. 4,600,020 granted July 15, 1986 to Mattei et al. for "Dual-rod cigarette manufacturing machine". The main difference is that each surplus removing apparatus comprises a frustoconical knife and a disc-shaped knife. This machine exhibits drawbacks which are similar to those of the machine disclosed by Seragnoli.

OBJECTS OF THE INVENTION

An object of the invention is to provide a novel and improved machine for simultaneously producing several streams of fibrous material wherein the surplus can be removed in such a way that the removal does not adversely affect the density and/or other important characteristics of the streams.

Another object of the invention is to provide combinations of novel and improved surplus removing apparatus for use in the above outlined machine.

A further object of the invention is to provide novel and improved combinations of surplus removing apparatus and stream conveyors for use in the above outlined apparatus.

An additional object of the invention is to provide novel and improved combinations of channels for streams of fibrous material and surplus removing apparatus.

Still another object of the invention is to provide the machine with novel and improved means for removing surplus material from a plurality of tobacco streams in such a way that each trimmed stream exhibits an optimum cross-sectional outlie for further processing.

An additional object of the invention is to provide a novel and improved machine for simultaneously producing a plurality of cigarette rods.

Another object of the invention is to provide a novel and improved method of distributing and orienting channels for streams of fibrous material, conveyors for such streams and surplus removing apparatus in a machine of the above outlined character.

A further object of the invention is to provide a multiple rod making machine which can transport several streams of fibrous material in close or immediate proximity to each other ahead of, at, as well as downstream of, the station where the streams are relieved of surplus by proven surplus removing apparatus.

SUMMARY OF THE INVENTION

The invention is embodied in a machine for simultaneously producing a plurality of rods which contain a fibrous material of the tobacco processing industry, particularly for producing two or more cigarette rods. The machine comprises first and second conveyors which define elongated paths, means for supplying fibrous material into first portions of the paths so that the conveyors accumulate and advance in a predetermined direction along the respective paths discrete first and second streams each of which contains a surplus of fibrous material, and discrete first and second surplus removing apparatus adjacent second portions of the respective paths downstream of the supplying means. Each apparatus comprises a pair of substantially coplanar rotary trimming discs.

The trimming discs of the first apparatus can be disposed in a first plane, and the trimming discs of the second apparatus can be disposed in a different second plane. The trimming discs are preferably rotatable about axes which extend substantially at right angles to the planes of the respective discs. The two planes can be inclined with reference to each other.

The machine further comprises first and second channels for the respective conveyors and for the respective streams. The channels have walls which flank the respective streams, and the mutual inclination of the aforementioned first and second planes can be such that the first plane bypasses the walls of the second channel and the second plane bypasses the walls of the first channel.

The first and second planes can be inclined in opposite directions with reference to a vertical plane extending in substantial parallelism with the two paths. Again, the first plane is preferably oriented in such a way that it bypasses the walls of the second channel and the orientation of the second plane is preferably such that this plane bypasses the walls of the fist channel.

In accordance with a modification, the two paths can be disposed in a common plane. The walls of the first channel are then inclined in a first direction with reference to a vertical plane which is normal to the common plane of the two paths, and the walls of the second channel are inclined with reference to the vertical plane in a second direction counter to the first direction. The plane of the trimming discs forming part of the first apparatus is then inclined relative to the vertical plane in the same direction as the walls of the first channel, and the plane of trimming discs forming part of the second apparatus is inclined relative to the vertical plane in the same direction as the walls of the second channel.

If the first and second conveyors are disposed in two mutually inclined planes, the common plane of trimming discs forming part of the first apparatus can be parallel to the plane of the first conveyor, and the common plane of trimming discs forming part of the second apparatus can be parallel to the plane of the second conveyor. The channels of such machine preferably include twisted portions, at least in the regions of the respective surplus removing apparatus.

The planes of the first and second conveyors can be parallel to each other, and such planes can be offset relative to each other in a direction transversely of the two paths.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is a similar transverse vertical sectional view of a modified machine wherein the streams to be relieved of surplus are disposed at the same level;

FIG. 5 is a similar transverse vertical sectional view of a third machine wherein the channel portions for the streams at the surplus removing station resemble spirals; and FIG. 6 is a similar transverse vertical sectional view of a fourth machine wherein the streams are advanced in a common plane and are relieved of surplus in mutually inclined portions of the channels.

DESCRIPTION OF PREFERRED EMBODIMENTS

Figure 1:
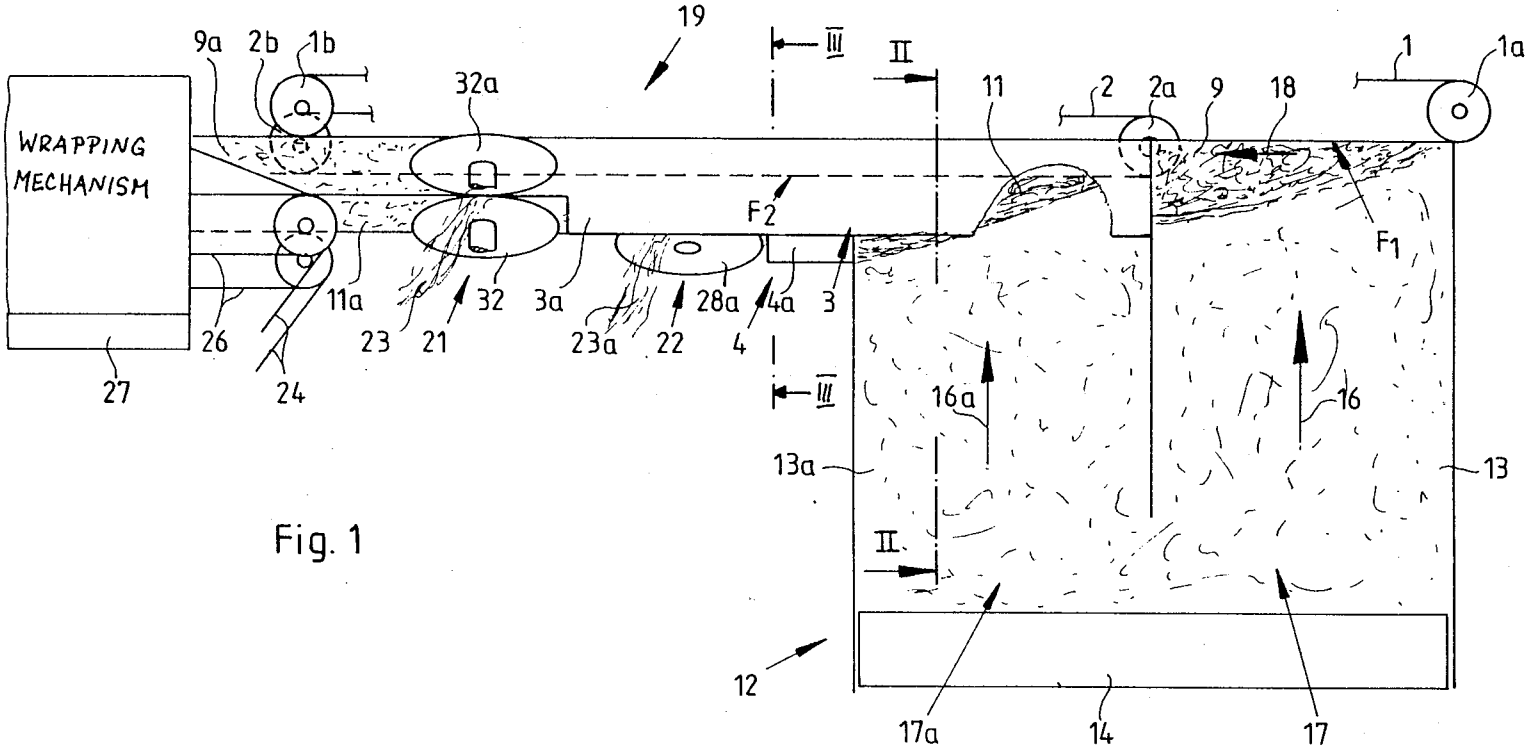
FIG. 1 is a fragmentary schematic partly elevational and partly vertical sectional view of a machine for making two cigarette rods and having two surplus removing apparatus embodying one form of the invention, the elevational view of FIG. 1 being taken in the direction of arrow I in FIG. 2.
Figure 2:
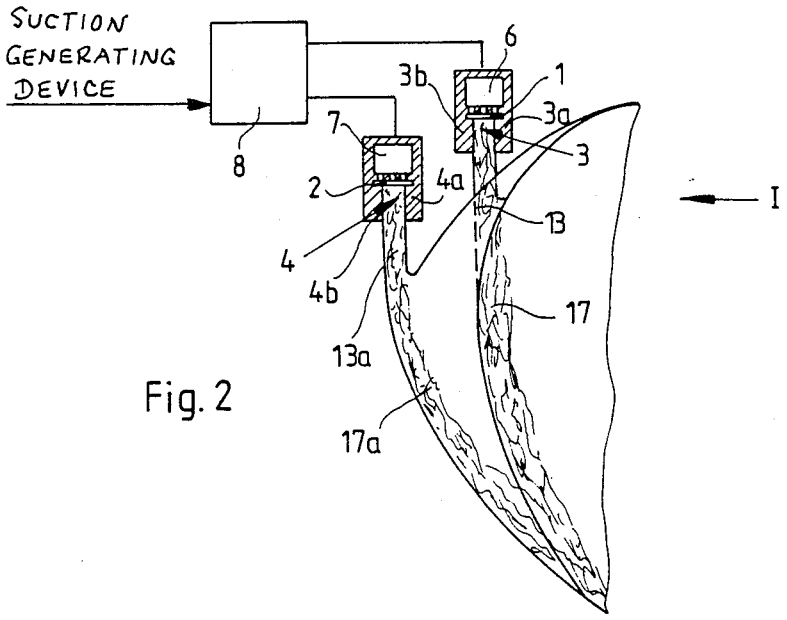
FIG. 2 is a fragmentary transverse vertical sectional view as seen in the direction of arrows from the line II—II of FIG. 1.
Figure 3:
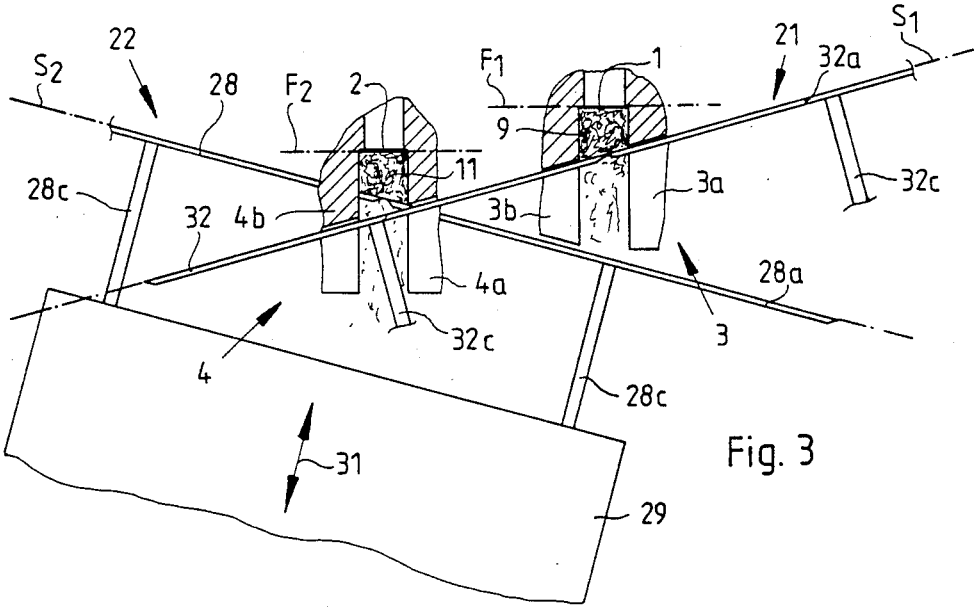
FIG. 3 is an enlarged transverse vertical sectional view as seen in the direction of arrows from the line III—III of FIG. 1.

Referring first to FIG. 1, there is shown a cigarette rod making machine which can produce two parallel cigarette rods. All such parts of the machine which are not essential for full understanding of the present invention are omitted or are shown only schematically. The machine comprises two endless foraminous belt conveyors 1, 2 which are respectively trained over pulleys 1*a*, 1*b* and 2*a*, 2*b*. The lower reach of the conveyor 1 defines an elongated substantially horizontal path between the sidewalls 3*a*, 3*b* of a first tobacco channel 3, and the lower reach of the conveyor 2 defines a second substantially horizontal elongated path between the sidewalls 4*a*, 4*b* of a second tobacco channel 4. The channels 3, 4 are shown in FIGS. 2 and 3. Suction chambers 6, 7 above the lower reaches of the conveyors 1 and 2 serve to establish pressure differentials which ensure that the undersides of the two reaches can retain and advance streams 9 and 11 of fibrous material (tobacco particles) which are to be trimmed or equalized by two discrete surplus removing apparatus 21, 22 at a trimming or equalizing station 19. These apparatus are constructed, operated and mounted in accordance with a feature of the present invention. The suction chambers 6 and 7 have outlets which are connected with a suction generating device 8 (e.g., a pump) which causes the suction chambers to draw streamlets of air upwardly through the lower reaches of the respective conveyors 1 and 2.

The means 12 for supplying particles of tobacco into first portions of the paths which are defined by the lower reaches of the conveyors 1 and 2 can be of the type fully described and shown in the commonly owned copending patent application Ser. No. 057,783 filed June 3, 1987 by Heitmann et al. for "Method of and apparatus for simultaneously making plural tobacco streams". The disclosure of this application is incorporated herein by reference. The supplying means 12 comprises two tobacco ducts 13, 13*a* and an accelerating roller 14 which serves to propel particles of natural, reconstituted and/or artificial tobacco in the direction of arrows 16, 16*a* so that the particles form two ascending flows 17, 17*a* which are converted into successive increments of the respective streams 9, 11 as soon as they impinge upon the undersides of the lower reaches of the conveyors 1 and 2 or upon the deposited particles. Upward flow of particles which form the flows 17, 17*a* is assisted by suction in the chambers 6 and 7. The supplying means 12 forms part of a distributor (also called hopper) which is or can be of the type disclosed in the aforementioned copending patent application Ser. No. 057,783. Other types of distributors can be used with similar or equal advantage. The accelerating roller 14 can be omitted if the supplying means 12 is equipped with suitably distributed nozzles which discharge jets of compressed air or another gaseous fluid to propel the particles of tobacco upwardly into the path portions above the upper ends of the ducts 13 and 13*a*. Such nozzles are shown in FIG. 1 of the copending patent application Ser. No. 057,783.

FIG. 2 shows that the lower reaches of the conveyors 1 and 2 are disposed in parallel planes at different levels. In this embodiment, the plane $F_1$ of the lower reach of the conveyor 1 (and hence of the tobacco stream 9) is located at a level above the plane $F_2$ of the lower reach of the conveyor 2 and tobacco stream 11. The direction of forward movement of the streams 9, 11 in the respective channels 3, 4 is indicated by arrow 18 (see the right-hand portion of FIG. 1). The conveyors 1 and 2 advance the streams 9 and 11 out of and beyond the tobacco supplying means 12 and into the range of the respective surplus removing apparatus 21 and 22. The means for returning the surplus 23, which is removed from the stream 9 by the apparatus 21, and for returning the surplus 23*a*, which is removed from the stream 11 by the apparatus 22, into the distributor is of conventional design and is not shown in FIG. 1. Reference may be had to FIG. 1 of the aforementioned copending patent application Ser. No. 057,783.

The trimmed streams 9*a* and 11*a* (i.e., the streams 9 and 11 minus the surpluses 23 and 23*a*) constitute fillers which are ready to be draped into webs 24 of cigarette paper or other suitable wrapping material in a conventional wrapping mechanism 27 which converts the fillers and the respective webs 24 into discrete cigarette rods ready to be subdivided into plain cigarettes of unit length or multiple unit length in a manner not forming part of the present invention. The webs 24 are delivered by the upper reaches of two endless belt conveyors 26 which serve to transport the webs and the respective fillers 9*a*, 11*a* through the wrapping mechanism 27.

The construction of relevant parts of the surplus removing apparatus 21 and 22 is shown in FIG. 3. The apparatus 21 comprises two coplanar flat rotary trimming discs 32, 32*a* which are located in a first plane $S_1$, and the apparatus 22 comprises two coplanar flat rotary trimming discs 28, 28*a* which are located in a second plane $S_2$. The plane $S_1$ makes an acute angle with the horizontal plane $F_1$ of the lower reach of the conveyor 1, and the plane $S_2$ makes an acute angle with the horizontal plane $F_2$ of the lower reach of the conveyor 2. The plane $F_2$ is located at a level below the plane $F_1$ and, therefore, the apparatus 22 is located ahead of the apparatus 21, as seen in the direction (arrow 18) of advancement of the streams 9, 11 from the first portions of the respective paths (above the ducts 13, 13*a*) toward the second path portions (station 19) which are respectively adjacent the apparatus 21 and 22. It will be seen that the planes $F_1$ and $F_2$ are rather closely adjacent and parallel to each other. The planes S and $S_2$ are inclined in opposite directions and make with the respective planes $F_1$ and $F_2$ relatively small acute angles (e.g., angles of approximately 15°). Such inclination suffices to ensure that the plane $S_2$ does not cross the walls 3*a*, 3*b* of the channel 3 for the stream 9, i.e., the channel 3 does not interfere with the trimming discs 28, 28*a* of the apparatus 22 while the discs 28, 28*a* remove the surplus 23*a* from the stream 11. The axes of the shafts 28*c* which drive the discs 28, 28*a* are disposed at right angles to the plane $S_2$, and the axes of shafts 32*c* for the discs 32, 32*a* of the apparatus 21 are normal to the plane $S_1$. The shafts 28*c* are mounted in a support 29 which can also carry a motor serving to transmit torque to the trimming discs 28 and 28*a*. The support 29 constitutes a means for changing the quantity of surplus 23*a* which is removed by the discs 28 and 28*a*. All that is necessary to change the quantity of the removed surplus 23*a* is to move the support 29 up or down (as indicated by the double-headed arrow 31). Such mode of changing the rate of removal of surplus from tobacco streams is well known in the art and is described and shown in numerous United States and foreign patents and patent applications of the assignee of the present application. The means for moving the support 29 up and down can receive signals from one or more devices which monitor the characteristics of the stream 11 or 11*a* or of the cigarette rod or plain cigarettes which are obtained as a result of severing of the wrapped filler 11*a*. The support (not shown) for the shafts 32*c* is analogous to the support 29.

The angle between the planes $S_1$ and $F_1$ can match or very closely approximate the angle between the planes $S_2$ and $F_2$. The angle between the planes $S_1$ and $F_1$ must be sufficiently large to ensure that the plane $S_1$ does not intersect the trimmed stream 11*a*.

It will be seen that the just described orientation of trimming discs 28, 28*a* and 32, 32*a* renders it possible to properly trim (i.e., remove the surplus from) two closely adjacent parallel streams 9 and 11 of fibrous material, and that the removal of such surplus can be carried out by resorting to proven flat disc-shaped rotary trimming discs. This is accomplished by the simple expedient of properly selecting the inclination of the trimming or surplus removal planes $S_1$ and $S_2$ relative to each other as well as relative to the horizontal planes $F_1$ and $F_2$ of the respective conveyors 1 and 2. The channel 3 cannot interfere with the surplus removing action of the apparatus 22, and the channel 4 cannot interfere with the surplus removing action of the apparatus 21.

FIG. 4 shows the surplus removing apparatus 21, 22 of a modified machine. The lower reaches of the conveyors 1, 2 in the respective channels 3, 4 are disposed in a common horizontal plane F, i.e., these lower reaches are disposed at the same level. The common plane $S_1$ of the trimming discs 32, 32*a* forming part of the apparatus 21 is inclined in a first direction with reference to a vertical plane V (normal to the plane F), and the common plane $S_2$ of the trimming discs 28, 28*a* forming part of the apparatus 22 is inclined with reference to the plane V in a second direction counter to the first direction. The planes $S_1$ and $S_2$ make a large obtuse angle. The angle $\alpha_1$ (inclination of the plane $S_1$ relative to the plane V) is the same as the angle $\alpha_2$ (inclination of the plane $S_2$ relative to the plane V). The character A denotes the distance between the plane $S_1$ and the channel 4. The distance between the plane $S_2$ and the channel 3 can match or approximate the distance A. This distance should suffice to ensure that the planes $S_1$ and $S_2$ can be moved up or down (note the arrow 31 in FIG. 3) through distances which suffice to ensure that the quantity of surplus (23, 23*a*) which is to be removed from the streams 9 and 11 can be varied within a desired or required range. The distance A will depend upon the magnitude of the angle $\alpha_1$.

FIG. 5 shows a portion of a third machine wherein the planes $F_3$ and $F_4$ of the lower reaches of the conveyors 1 and 2 are inclined in opposite directions with reference to the vertical plane V. This vertical plane is located midway between the channels 3, 4 and extends in parallelism with the paths of the streams 9, 11 between the sidewalls of the corresponding channels. The illustrated mutual inclination of the planes $F_3$ and $F_4$ can be achieved by twisting the channels 3 and 4 so that they form portions of spirals, at least in the regions of the respective surplus removing apparatus 21 and 22. The manner of twisting the channels 3 and 4 is or can be the same as disclosed in commonly owned U.S. Pat. No. 4,620,552 granted Nov. 4, 1986 to Hinzmann for "Method and apparatus for making and manipulating streams of fibrous material". The patent to Hinzmann discloses a twisting of tobacco channels and of the conveyors therein through 180°. In the machine of FIG. 5, the channels 3 and 4 must be twisted only through fractions of 180°. Thus, all that is necessary is to twist the channel 3 through an angle to move the plane $F_3$ from a horizontal position to the inclination of FIG. 5 and back to the horizontal position, and the same holds true for twisting of the channel 4 and plane $F_4$ of the lower reach of the conveyor 2. The common plane $S_1$ of the trimming discs 32, 32*a* forming part of the apparatus 21 is parallel to the plane $F_3$, and the common plane $S_2$ of trimming discs 28, 28*a* forming part of the apparatus 22 is parallel to the plane $F_4$, i.e., the planes $S_1$ and $S_2$ are also inclined with reference to the vertical plane V.

An advantage of the machine which embodies the apparatus 21 and 22 of FIG. 5 is that the trimmed streams 9 and 11 have a substantially square or slightly rectangular cross-sectional outline in contrast to the substantially trapezoidal cross-sectional outlines of the trimmed streams which are shown in FIGS. 3 and 4. This is due to the fact that the planes $S_1$ and $S_2$ of FIG. 5 are respectively parallel to the planes $F_3$ and $F_4$. A square or rectangular cross-sectional outline is customary in standard machines which turn out a single cigarette rod.

FIG. 6 shows a portion of a fourth machine wherein the lower reaches of the conveyors 1 and 2 are disposed in a common horizontal plane F, and the planes $S_1$ and $S_2$ are inclined in opposite directions with reference to a vertical plane V which extends at right angles to the plane F in the longitudinal direction of the paths for the streams 9 and 11. A difference between the machines of FIGS. 4 and 6 is that the sidewalls 38 of the channel 41 are inclined with reference to the vertical plane V in a first direction, and that the sidewalls 39 of the channel 42 are inclined with reference to the vertical plane V in a second direction counter to the first direction. The inclination of the planes $S_1$ and $S_2$ with reference to the vertical plane V is selected with a view to ensure that the channel 41 cannot interfere with the trimming discs 28, 28*a* of the apparatus 22 and that the channel 42 cannot interfere with the trimming discs 32, 32*a* of the apparatus 21.

An important advantage of the improved machine is that it renders it possible to remove the surplus from a plurality of closely adjacent streams by resorting to proven surplus removing apparatus which operate with pairs of coplanar trimming discs. Such apparatus are simple, compact and effective. Moreover, it is rather simple to regulate the rate of removal of the surplus by the expedient of moving the supports for the pairs of flat trimming discs closer to or further away from the planes of the respective conveyors. In addition, flat trimming discs do not have any components of movement toward the respective conveyors so that they cannot adversely influence the density of the respective streams ahead of the actual trimming stations. Still further, it is possible to select a variety of orientations of the planes of trimming discs relative to each other and/or relative to the plane or planes of the conveyors and/or relative to the planes of the walls of the channels. Such versatility is desirable and advantageous if it is necessary to convert an existing multiple rod making machine for operation in accordance with the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Machine for simultaneously producing a plurality of rods which contain a fibrous material of the tobacco processing industry, comprising first and second conveyors defining elongated paths; means for supplying fibrous material into first portions of said paths so that the first and second conveyors accumulate and advance along the respective paths discrete first and second streams each of which contains a surplus of fibrous material; and discrete first and second surplus removing apparatus adjacent second portions of the respective paths downstream of said supplying means, each of said apparatus comprising a pair of substantially coplanar rotary trimming discs, the trimming discs of said first apparatus being disposed in a first plane and the trimming discs of said second apparatus being disposed in a different second plane.

2. The machine of claim 1, wherein said trimming discs are rotatable about axes extending substantially at right angles to the planes of the respective trimming discs.

3. Machine for simultaneously producing a plurality of rods which contain a fibrous material of the tobacco processing industry, comprising first and second conveyors defining elongated paths; means for supplying fibrous material into first portions of said paths so that the first and second conveyors accumulate and advance along the respective paths discrete first and second streams each of which contains a surplus of fibrous material; and discrete first and second surplus removing apparatus adjacent second portions of the respective paths downstream of said supplying means, each of said apparatus comprising a pair of substantially coplanar rotary disposed in a first plane and the trimming discs of said second apparatus being disposed in a second plane which is inclined with reference to said first plane.

4. The machine of claim 3, further comprising first and second channels for the respective conveyors and the respective streams, said channels having walls flanking the respective streams and the mutual inclination of said planes being such that said first plane bypasses the walls of said second channel and said second plane bypasses the walls of said first channel.

5. Machine for simultaneously producing a plurality of rods which contain a fibrous material of the tobacco processing industry, comprising first and second conveyors defining elongated paths; means for supplying fibrous material into first portion of said paths so that the first and second conveyors accumulate and advance along the respective paths discrete first and second streams each of which contains a surplus of fibrous material; and discrete first and second surplus removing apparatus adjacent second portions of the respective paths downstream of said supplying means, each of said apparatus comprising a pair of substantially coplanar rotary trimming discs, the trimming discs of said first apparatus being disposed in a first plane and the trimming discs of said second apparatus being disposed in a second plane, said first and second planes being disposed in a second plane, said first and second planes being inclined in opposite directions with respect to a vertical plane extending in substantial parallelism with said paths.

6. The machine of claim 5, further comprising first and second channels for the respective conveyors and the respective streams, said channels having walls flanking the respective streams and the inclination of said first and second planes relative to said vertical plane being such that said first plane bypasses the walls of said second channel and said second plane bypasses the walls of said first channel.

7. The machine of claim 1, wherein said paths are disposed in a common plane.

8. Machine for simultaneously producing a plurality of rods which contain a fibrous material of the tobacco processing industry, comprising first and second conveyors defining elongated paths which are disposed in a common plane; means for supplying fibrous material into first portions of said paths so that the first and second conveyors accumulate and advance along the respective paths discrete first and second streams each of which contains a surplus of fibrous material; first and second channels for the respective conveyors and the respective streams, said channels having walls flanking the respective streams and the walls of said first channel being inclined in a first direction with reference to a second plane which is normal to said common plane, the walls of said second channel being inclined with reference to said second plane in a second direction counter to said first direction; and discrete first and second surplus removing apparatus adjacent second portions of the respective paths downstream of said supplying means, each of said apparatus comprising a pair of substantially coplanar rotary trimming discs.

9. The machine of claim 8, wherein the trimming discs of said first apparatus are disposed in a third plane which is inclined relative to said second plane in the same direction as the walls of said first channel, the trimming discs of said second apparatus being disposed in a fourth plane which is inclined relative to the second plane in the same direction as the walls of said second channel.

10. Machine for simultaneously producing a plurality of rods which contain a fibrous material of the tobacco processing industry, comprising first and second conveyors defining elongated paths and respectively disposed in first and second planes; means for supplying fibrous material into first portions of said paths so that the first and second conveyors accumulate and advance along the respective paths discrete first and second streams each of which contains a surplus of fibrous material; and discrete first and second surplus removing apparatus adjacent second portions of the respective paths downstream of said supplying means, each of said apparatus comprising a pair of substantially coplanar rotary trimming discs, the trimming discs of said first apparatus being disposed in a third plane which is substantially parallel to said first plane and the trimming discs of said second apparatus being disposed in a fourth plane which is substantially parallel to said second plane.

11. The machine of claim 10, further comprising first and second channels for the respective conveyors and the respective streams, said channels having twisted portions in the regions of the respective surplus removing apparatus.

12. Machine for simultaneously producing a plurality of rods which contain a fibrous material of the tobacco processing industry, comprising first and second conveyors defining elongated paths and being respectively disposed in first and second planes which are parallel to and vertically spaced apart from each other; means for supplying fibrous material into first portions of said paths so that the first and second conveyors accumulate and advance along the respective paths first and second streams each of which contains a surplus of fibrous material; and discrete first and second surplus removing apparatus adjacent second portions of the respective paths downstream of said supplying means, each of said apparatus comprising a pair of substantially coplanar rotary trimming discs.

13. The apparatus of claim 12, wherein said paths are laterally offset relative to each other.

* * * * *